US011128025B2

(12) United States Patent
Chen et al.

(10) Patent No.: US 11,128,025 B2
(45) Date of Patent: Sep. 21, 2021

(54) SIGNAL TRANSMISSION DEVICE

(71) Applicant: Wistron NeWeb Corp., Hsinchu (TW)

(72) Inventors: Szu-Yuan Chen, Hsinchu (TW); Man-Ning Lu, Hsinchu (TW); Chiung-Wen Hsin, Hsinchu (TW); Yi-Chieh Lin, Hsinchu (TW)

(73) Assignee: WISTRON NEWEB CORP., Hsinchu (TW)

( * ) Notice: Subject to any disclaimer, the term of this patent is extended or adjusted under 35 U.S.C. 154(b) by 28 days.

(21) Appl. No.: 16/700,051

(22) Filed: Dec. 2, 2019

(65) Prior Publication Data

US 2020/0365984 A1 Nov. 19, 2020

(30) Foreign Application Priority Data

May 14, 2019 (TW) ..... 108116527

(51) Int. Cl.

| | |
|---|---|
| ***H01Q 1/02*** | (2006.01) |
| ***H01Q 9/28*** | (2006.01) |
| ***H01Q 21/00*** | (2006.01) |
| ***H01Q 21/08*** | (2006.01) |
| ***H01Q 1/12*** | (2006.01) |

(Continued)

(52) U.S. Cl.

CPC ..... *H01Q 1/02* (2013.01); *H01Q 1/1207* (2013.01); *H01Q 1/241* (2013.01); *H01Q 1/523* (2013.01); *H01Q 9/16* (2013.01); *H01Q 9/285* (2013.01); *H01Q 21/0025* (2013.01); *H01Q 21/065* (2013.01); *H01Q 21/08* (2013.01); *H01Q 21/20* (2013.01); *H01Q 21/28* (2013.01); *H01Q 23/00* (2013.01)

(58) Field of Classification Search

CPC ..... H01Q 1/02; H01Q 1/2283; H01Q 1/52; H01Q 1/521; H01Q 1/523; H01Q 1/525; H01Q 1/526; H01Q 1/241; H01Q 1/1207; H01Q 9/285; H01Q 9/16; H01Q 21/0025; H01Q 21/20; H01Q 21/28; H01Q 21/08; H01Q 21/065; H01Q 23/00

See application file for complete search history.

(56) References Cited

U.S. PATENT DOCUMENTS

| | | | |
|---|---|---|---|
| 2009/0102677 A1 | 4/2009 | Patel et al. | |
| 2017/0062899 A1* | 3/2017 | Takahashi | H01Q 1/2291 |

(Continued)

FOREIGN PATENT DOCUMENTS

| | | |
|---|---|---|
| CN | 204391241 U | 6/2015 |
| CN | 107148200 A | 9/2017 |

*Primary Examiner* — Robert Karacsony

(74) *Attorney, Agent, or Firm* — McClure, Qualey & Rodack, LLP

(57) ABSTRACT

A signal transmission device is provided. The signal transmission device includes a heat dissipation member, a first antenna module and a positioning clamp. The first antenna module is disposed on the heat dissipation member and thermally connected to the heat dissipation member. The positioning clamp is disposed on the heat dissipation member. The first antenna module is sandwiched between the positioning clamp and the heat dissipation member. The positioning clamp is adapted to restrict the first antenna module. The positioning clamp includes a plurality of clamp openings and a plurality of spacing ribs. At least a few of the clamp openings correspond to the first antenna module, and the clamp openings are defined by the spacing ribs.

16 Claims, 8 Drawing Sheets

(51) Int. Cl.

| | |
|---|---|
| ***H01Q 21/28*** | (2006.01) |
| ***H01Q 23/00*** | (2006.01) |
| ***H01Q 1/24*** | (2006.01) |
| ***H01Q 1/52*** | (2006.01) |
| ***H01Q 21/20*** | (2006.01) |
| ***H01Q 21/06*** | (2006.01) |
| ***H01Q 9/16*** | (2006.01) |

(56) References Cited

U.S. PATENT DOCUMENTS

2020/0287268 A1* 9/2020 Moon ..... H01Q 1/243
2020/0329550 A1* 10/2020 Seo ..... H01Q 1/02

* cited by examiner

SIGNAL TRANSMISSION DEVICE

CROSS REFERENCE TO RELATED APPLICATIONS

This Application claims priority of Taiwan Patent Application No. 108116527, filed on May 14, 2019, the entirety of which is incorporated by reference herein.

BACKGROUND OF THE INVENTION

Field of the Invention

The present invention relates to a signal transmission device, and in particular to a signal transmission device with a uniform radiation pattern.

Description of the Related Art

In a conventional signal transmission device, the antenna module is disposed on the printed circuit board, and is located on the edge of the printed circuit board. However, the antenna module may experience interference caused by the elements that surround it. Moreover, the radiation pattern of the antenna module is not uniform, and the transmission quality of the antenna module suffers. With the development of 5G technology, when the frequency of a wireless signal is high (for example, between 28 GHz and 39 GHz), any element within the range of the radiation pattern may seriously affect the transmission of the antenna module.

BRIEF SUMMARY OF THE INVENTION

In one embodiment, a signal transmission device is provided. The signal transmission device includes a heat dissipation member, a first antenna module and a positioning clamp. The first antenna module is disposed on the heat dissipation member and thermally connected to the heat dissipation member. The positioning clamp is disposed on the heat dissipation member. The first antenna module is sandwiched between the positioning clamp and the heat dissipation member. The positioning clamp is adapted to restrict the first antenna module. The positioning clamp comprises a plurality of clamp openings and a plurality of spacing ribs. At least a few of the clamp openings correspond to the first antenna module. The clamp openings are defined by the spacing ribs.

In one embodiment, the first antenna module comprises a plurality of first antenna units, and each spacing rib is disposed between the two adjacent first antenna units.

In one embodiment, each first antenna unit comprises a first dipole antenna area, and each rib comprises a rib notch. The notch width of the rib notch in the extending direction of the spacing rib is greater than or equal to the width of the first dipole antenna area in the extending direction of the spacing rib.

In one embodiment, each first antenna unit further comprises a first patch antenna area, the first dipole antenna area comprises a dipole antenna and an empty area, and the empty area is located between the dipole antenna and the first patch antenna area.

In one embodiment, the first antenna module comprises a plurality of ground areas, each ground area is located between the two adjacent first patch antenna areas, and the spacing ribs respectively contact the ground areas.

In one embodiment, the clamp opening is rectangular, and the clamp opening comprises a first edge, a second edge, a third edge, and a fourth edge. The first edge is parallel to the second edge. The third edge is parallel to the fourth edge. The first edge is perpendicular to the third edge. The third edge is located on the spacing rib. The first edge is adjacent to the first dipole antenna area relative to the second edge. A first gap is formed between the first edge and the first antenna module. The first gap is greater than 2 mm.

In one embodiment, a second gap is formed between the second edge and the first antenna module, and the second gap is greater than 2 mm.

In one embodiment, the first antenna module further comprises a module circuit board and a module chip, the module circuit board comprises a first surface and a second surface, the first surface is opposite the second surface, the first antenna unit is disposed on the first surface, the module chip is disposed on the second surface, and the module chip is thermally connected to the heat dissipation member.

In one embodiment, the heat dissipation member comprises a receiving groove, the first antenna module is disposed in the receiving groove, and the module chip is thermally connected to the receiving groove.

In one embodiment, the signal transmission device further comprises a bolt, wherein the bolt affixes the positioning clamp to the heat dissipation member.

In one embodiment, the signal transmission device further comprises a second antenna module and a third antenna module, the positioning clamp comprises a first section, a second section and a third section, the first section is adapted to restrict the first antenna module, the second section is adapted to restrict the second antenna module, the third section is adapted to restrict the third antenna module, and the first antenna module is located between the second antenna module and the third antenna module.

In one embodiment, the heat dissipation member comprises a planar surface, a first inclined surface and a second inclined surface, the planar surface is located between the first inclined surface and the second inclined surface, the first antenna module is disposed on the planar surface, the second antenna module is disposed on the first inclined surface, and the third antenna module is disposed on the second inclined surface.

In one embodiment, the heat dissipation member comprises a heat dissipation member protrusion, the first dipole antenna area and the first patch antenna area of each first antenna unit are arranged in a first direction, the first patch antenna area is located between the first dipole antenna area and the heat dissipation member protrusion, the second antenna module comprises a second dipole antenna area and a second patch antenna area, the second dipole antenna area and the second patch antenna area are arranged in a second direction, and the first direction is the opposite of the second direction.

In one embodiment, the signal transmission device further comprises a mainboard and a device housing, the heat dissipation member is partially located between the first antenna module and the mainboard, and the device housing covers the first antenna module and the heat dissipation member.

In one embodiment, a third gap is formed between the first antenna module and the device housing, a fourth gap is formed between the first antenna module and the mainboard, and the third gap is less than 30% of the sum of the third gap and the fourth gap.

In one embodiment, the signal transmission device further comprises a thermal pad, the thermal pad is attached to the heat dissipation member, and the thermal pad contacts the device housing.

In one embodiment, the signal transmission device further comprises a central processing unit, a 5G baseband module, a 4G baseband unit and an LTE baseband unit, wherein the central processing unit, the 5G baseband module, the 4G baseband unit and the LTE baseband unit are disposed on the mainboard, the 4G baseband unit is located between the central processing unit and the 5G baseband module, and the 5G baseband unit is located between the 4G baseband unit and the LTE baseband unit.

Utilizing the signal transmission device of the embodiment of the invention, the first antenna module is disposed on the heat dissipation member, and the heat dissipation member is partially located between the first antenna module and the mainboard. Therefore, there is less interference on the first antenna module coming from the mainboard. Additionally, the heat generated by the first antenna module is directly dissipated via the heat dissipation member, and an improved heat dissipation effect is achieved.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
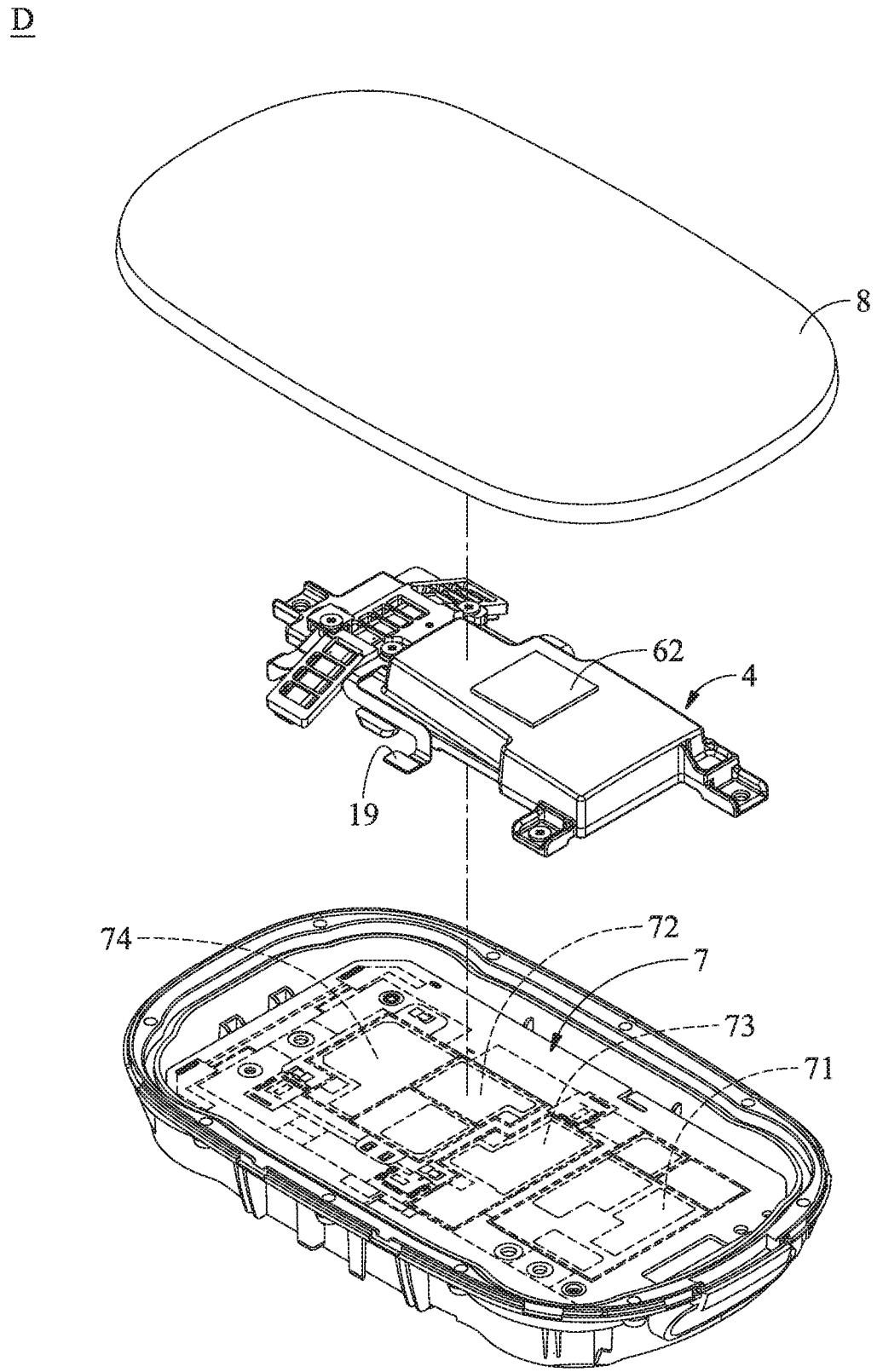
FIG. 1 is an exploded view of a signal transmission device of an embodiment of the invention.
Figure 2:
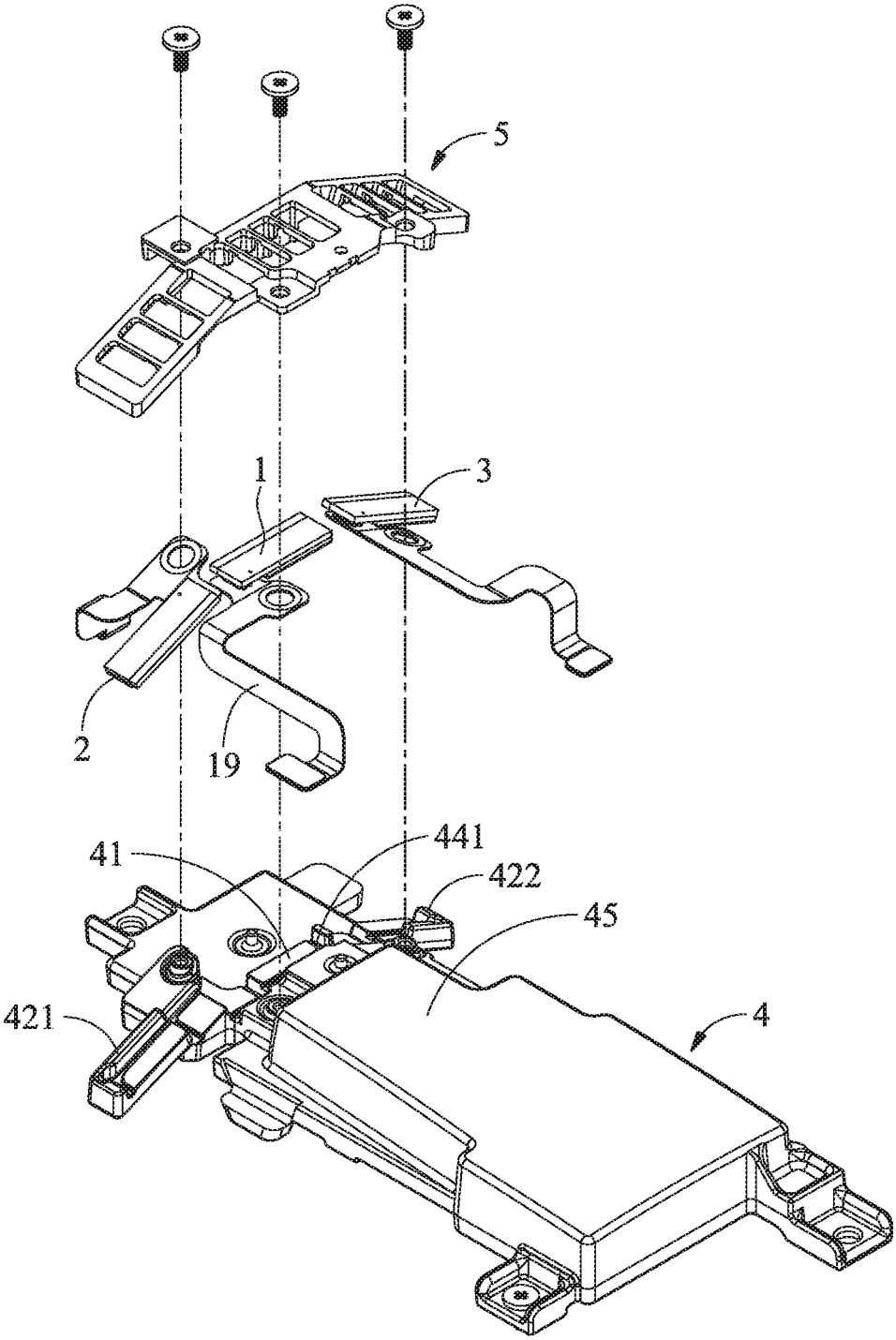
FIG. 2 is an exploded view of the major elements of the signal transmission device of the embodiment of the invention.
Figure 3A:
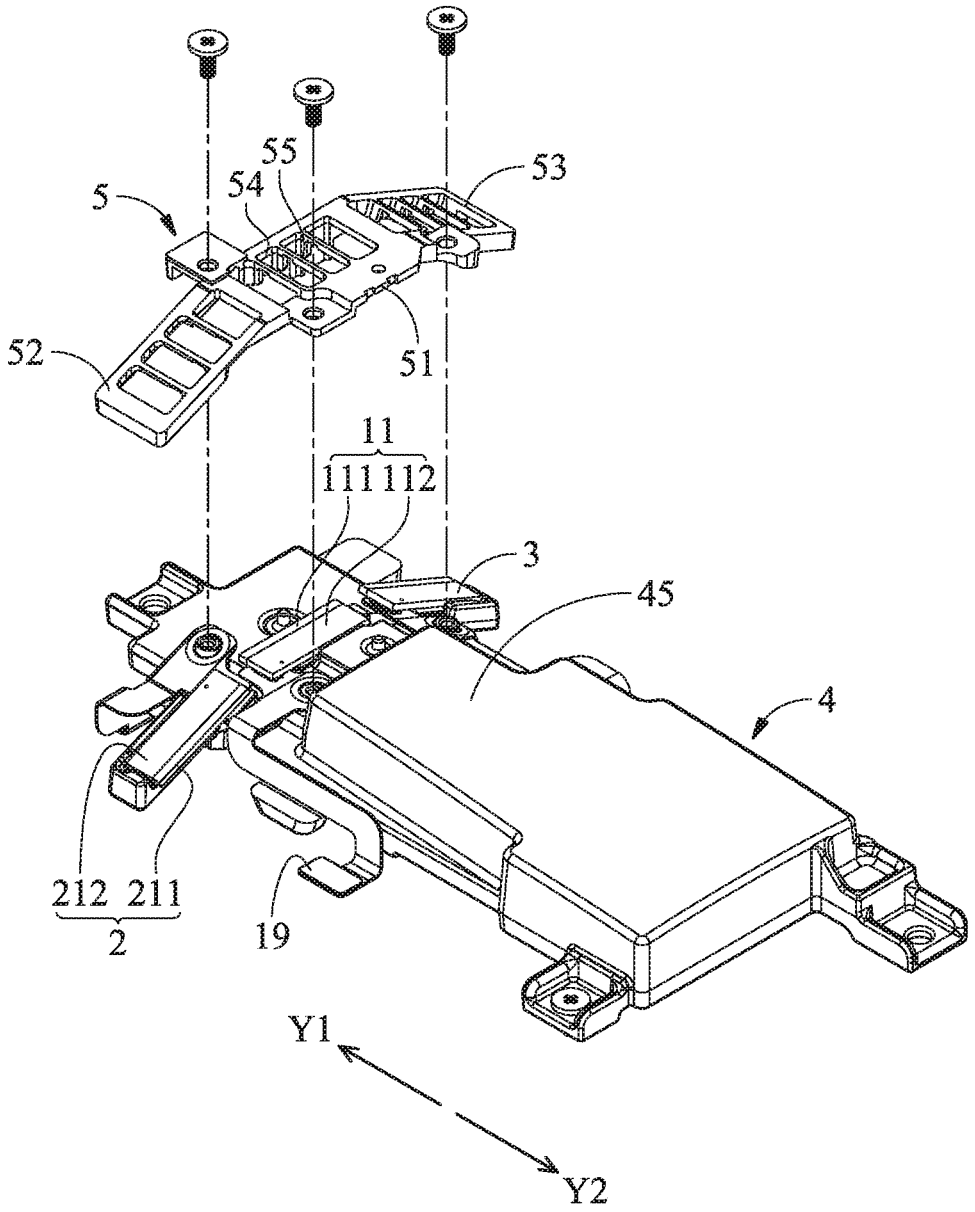
FIGS. 3A and 3B are assembled views of the major elements of the signal transmission device of the embodiment of the invention.
Figure 3B:
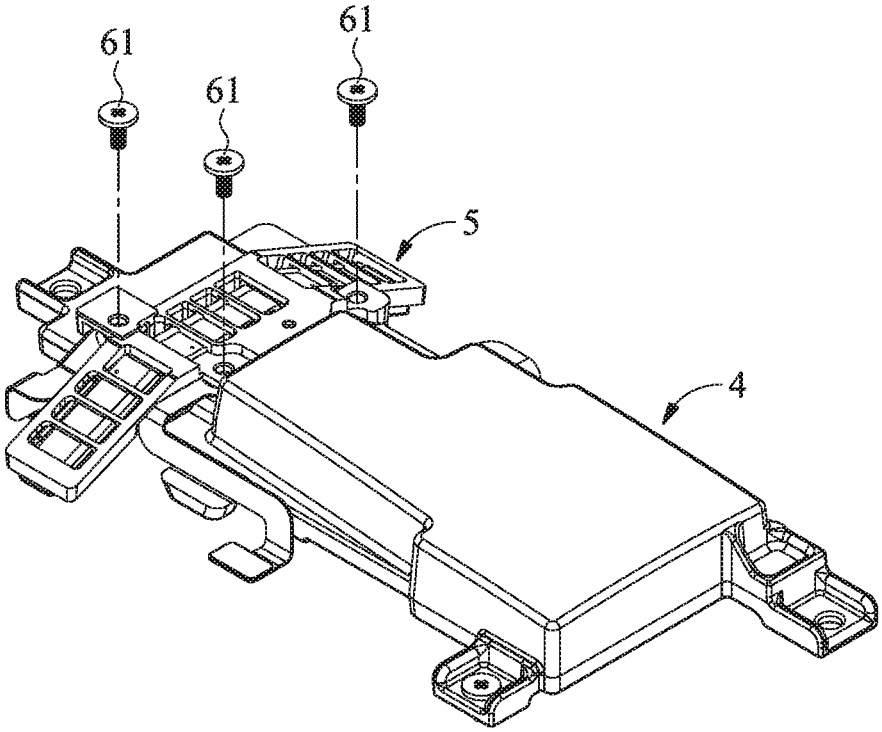

FIG. 1 is an exploded view of a signal transmission device D of an embodiment of the invention. FIG. 2 is an exploded view of the major elements of the signal transmission device D of the embodiment of the invention. FIGS. 3A and 3B are assembled views of the major elements of the signal transmission device D of the embodiment of the invention. With reference to FIGS. 1, 2, 3A and 3B, in one embodiment, the signal transmission device D includes a heat dissipation member 4, a first antenna module 1 and a positioning clamp 5. The first antenna module 1 is disposed on the heat dissipation member 4 and thermally connected to the heat dissipation member 4. The positioning clamp 5 is affixed to the heat dissipation member 4. The first antenna module 1 is sandwiched between the positioning clamp 5 and the heat dissipation member 4. The positioning clamp 5 is adapted to restrict the first antenna module 11. The positioning clamp 5 comprises a plurality of clamp openings 54 and a plurality of spacing ribs 55. At least some of the clamp openings 54 correspond to the first antenna module 1. The clamp openings 54 are defined by the spacing ribs 55.

Figure 4A:
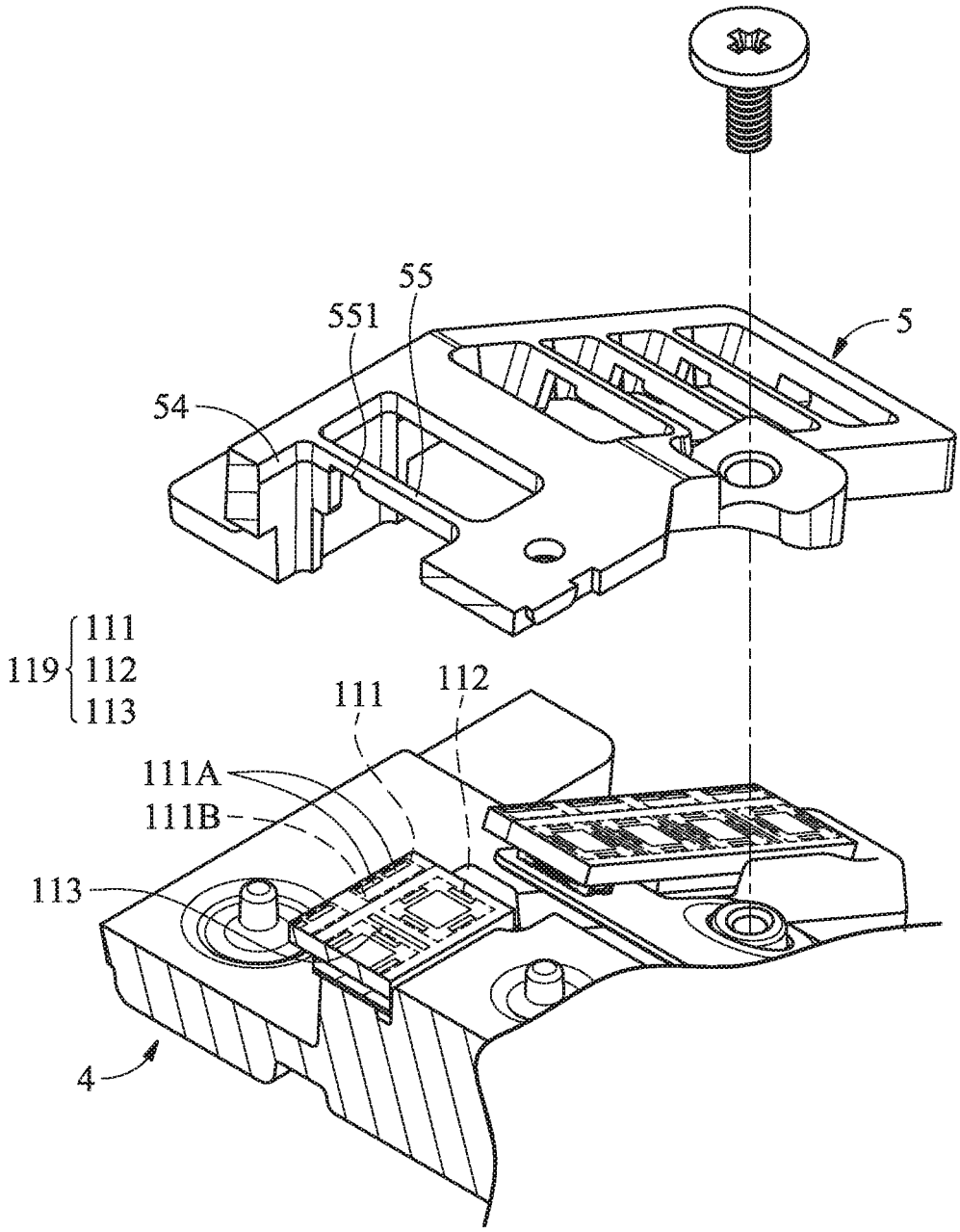
FIG. 4A shows the details of a first antenna unit of the embodiment of the invention.
Figure 4B:
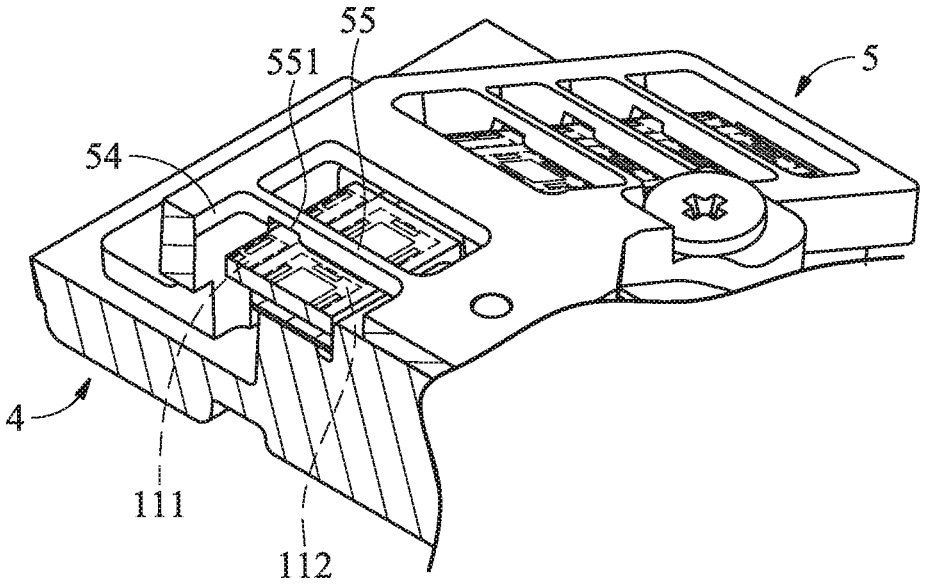
FIG. 4B shows the first antenna unit assembled with a positioning clamp of the embodiment of the invention.

With reference to FIGS. 4A and 4B, in one embodiment, the first antenna module 1 comprises a plurality of first antenna units 119, and each spacing rib 55 is disposed between the two adjacent first antenna units 119. In one embodiment, each first antenna unit 119 comprises a first dipole antenna area 111. Each spacing rib 55 comprises a rib notch 551. The notch width of the rib notch 551 in the extending direction of the spacing rib 55 is greater than or equal to the width of the first dipole antenna area 111 in the extending direction of the spacing rib 55. In this embodiment, the rib notch 551 corresponds to the first dipole antenna area 111, interference from the spacing rib 55 on the first dipole antenna area 111 is therefore decreased, and better transmission quality may be achieved.

With reference to FIGS. 4A and 4B, in one embodiment, each first antenna unit 119 further comprises a first patch antenna area 112. In this embodiment, the first dipole antenna area 111 comprises two dipole antennas 111A and an empty area 111B. The empty area 111B is located between the dipole antenna 111A and the first patch antenna area 112. The interference between the dipole antenna 111A and the patch antenna in the first patch antenna area 112 can be reduced, improving the quality of the transmission.

With reference to FIGS. 4A and 4B, in one embodiment, the first antenna module 1 comprises a plurality of ground areas 113. Each ground area 113 is located between the two adjacent first patch antenna areas 112. In one embodiment, the spacing ribs 55 respectively contact the ground areas 113. The spacing ribs 55 respectively contact the ground areas 113 to prevent the spacing rib 55 from covering the first dipole antenna area 111 or the first patch antenna area 112, and to reduce the influence of the spacing rib 55 toward the signal transmission.

Figure 5:
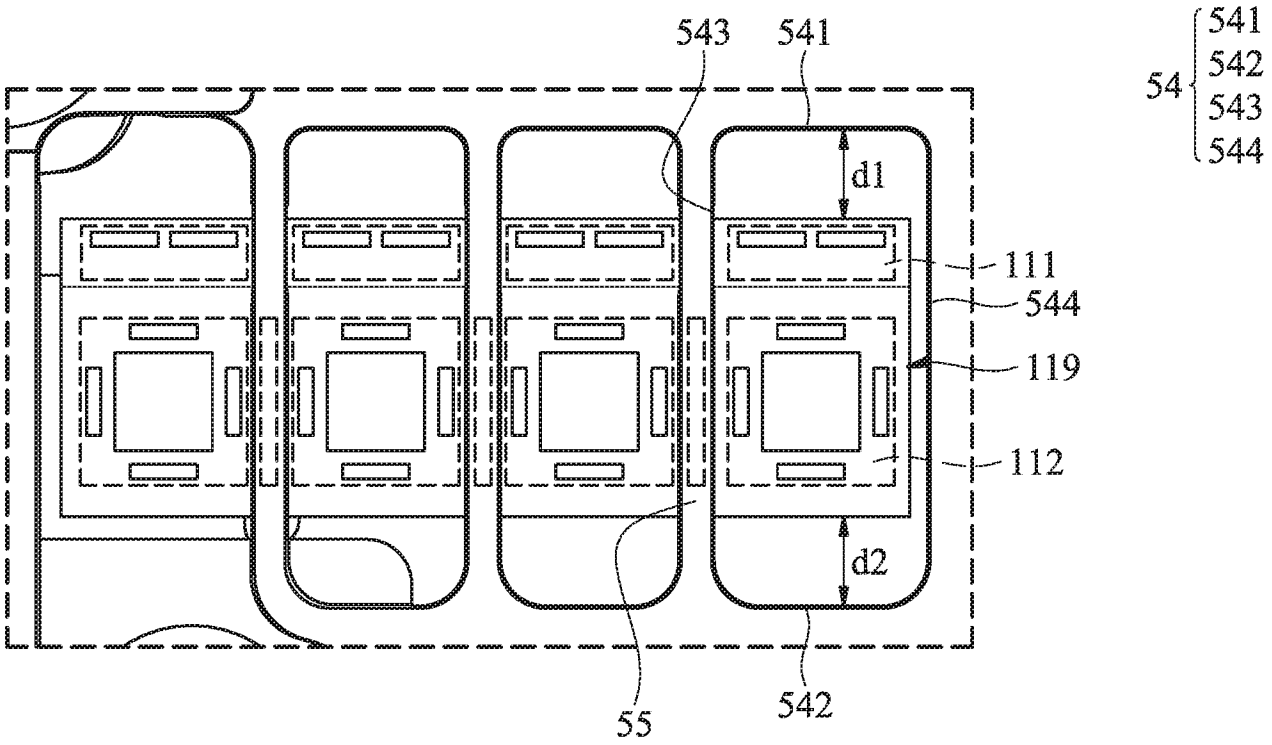
FIG. 5 shows the details of a clamp opening of the embodiment of the invention.

FIG. 5 shows the details of the clamp opening of the embodiment of the invention. With reference to FIG. 5, in one embodiment, the clamp opening 54 is rectangular. The clamp opening 54 comprises a first edge 541, a second edge 542, a third edge 543, and a fourth edge 544. The first edge 541 is parallel to the second edge 542. The third edge 543 is parallel to the fourth edge 544. The first edge 541 is perpendicular to the third edge 543. The third edge 543 is located on the spacing rib 55. The first edge 541 is adjacent to the first dipole antenna area 111 relative to the second edge 542. The first gap d1 is formed between the first edge 541 and the first antenna module 1, and the first gap d1 is greater than 2 mm.

With reference to FIG. 5, in one embodiment, a second gap d2 is formed between the second edge 542 and the first antenna module 1, and the second gap d2 is greater than 2 mm.

In the embodiment above, the first gap d1 is greater than 2 mm and the second gap d2 is greater than 2 mm. Therefore, there is less interference on the first antenna module 11 coming from the positioning clamp 5, and the quality of the signal transmission of the first antenna module 11 is improved.

Figure 6:
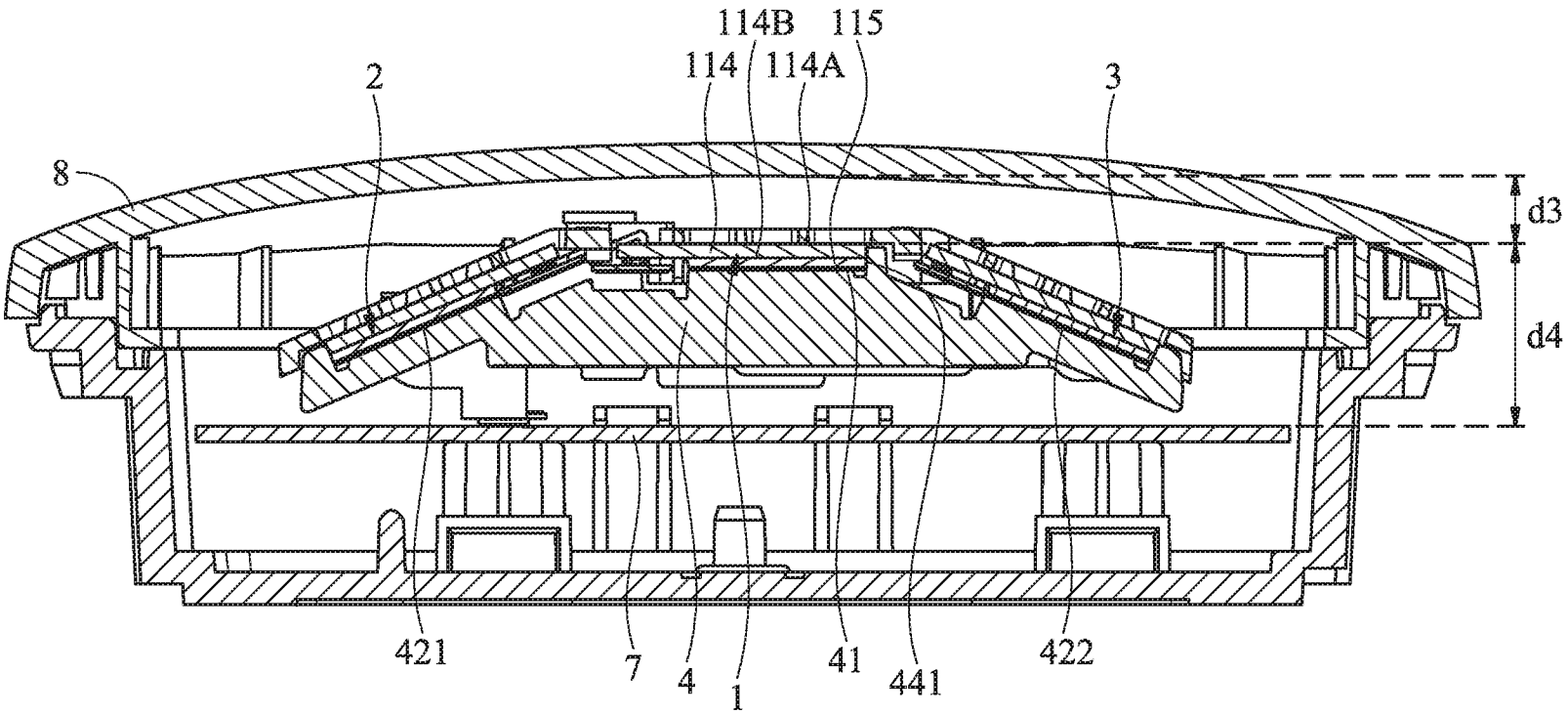
FIG. 6 is a cross sectional view of the major elements of the signal transmission device of the embodiment of the invention.

FIG. 6 is a cross sectional view of the major elements of the signal transmission device D of the embodiment of the invention. With reference to FIG. 6, in one embodiment, the first antenna module 1 further comprises a module circuit board 114 and a module chip 115. The module circuit board 114 comprises a first surface 114A and a second surface 114B. The first surface 114A is opposite the second surface 114B. The first antenna unit 119 is disposed on the first surface 114A. The module chip 115 is disposed on the second surface 114B. The module chip 115 is thermally connected to the heat dissipation member 4. In this embodiment, the heat generated by the module chip 115 is directly dissipated by the heat dissipation member 4, and the improved heat dissipation is achieved.

With reference to FIGS. 2 and 6, in one embodiment, the heat dissipation member 4 comprises a receiving groove 441. The first antenna module 1 is disposed in the receiving groove 441. The module chip 115 is thermally connected to the receiving groove 441. The receiving groove 441 is adapted to abut the first antenna module 1 and to restrict the freedom of the first antenna module 1.

With reference to FIG. 3B, in one embodiment, the signal transmission device D further comprises a bolt 61, wherein the bolt 61 affixes the positioning clamp 5 to the heat dissipation member 4.

With reference to FIGS. 2, 3A and 3B, in one embodiment, the signal transmission device D further comprises a second antenna module 2 and a third antenna module 3. The positioning clamp 5 comprises a first section 51, a second section 52 and a third section 53. The first section 51 is adapted to restrict the position of the first antenna module 1. The second section 52 is adapted to restrict the position of the second antenna module 2. The third section 53 is adapted to restrict the position of the third antenna module 3. The first antenna module 1 is located between the second antenna module 2 and the third antenna module 3.

With reference to FIGS. 2, 3A, 3B and 6, in one embodiment, the heat dissipation member 4 comprises a planar surface 41, a first inclined surface 421 and a second inclined surface 422. The planar surface 41 is located between the first inclined surface 421 and the second inclined surface 422. The first antenna module 1 is disposed on the planar surface 41. The second antenna module 2 is disposed on the first inclined surface 421. The third antenna module 3 is disposed on the second inclined surface 422.

With reference to FIG. 6, in this embodiment, the planar surface 41, the first inclined surface 421 and the second inclined surface 422 are wing-shaped arranged in the cross section as shown in FIG. 6. In one embodiment, an included angle between the first inclined surface 421 and the planar surface 41 can be 135 degrees, and an included angle between the second inclined surface 422 and the planar surface 41 can be 135 degrees. Utilizing the arrangement mentioned above, the first antenna module, the second antenna module 2 and the third antenna module 3 provide uniform and complete radiation pattern.

With reference to FIGS. 2, 3A, 3B and 6, in one embodiment, the heat dissipation member 4 comprises a heat dissipation member protrusion 45. The first antenna module 1 corresponds to the heat dissipation member protrusion 45. The first dipole antenna area 111 and the first patch antenna area 112 are arranged in a first direction Y1. The first patch antenna area 112 is located between the first dipole antenna area 111 and the heat dissipation member protrusion 45. The second antenna module 2 comprises a second dipole antenna area 211 and a second patch antenna area 212. The second dipole antenna area 211 and the second patch antenna area 212 are arranged in a second direction Y2. The first direction Y1 is the opposite of the second direction Y2. Therefore, the second dipole antenna area 211 is protected against interference from the heat dissipation member protrusion 45.

With reference to FIGS. 1 and 6, in one embodiment, the signal transmission device D further comprises a mainboard 7 and a device housing 8. The heat dissipation member 4 is partially located between the first antenna module 1 and the mainboard 7. The device housing 8 covers the first antenna module 1 and the heat dissipation member 4. Since the heat dissipation member 4 is partially located between the first antenna module 1 and the mainboard 7, there is less interference from the mainboard 7 on the first antenna module 1.

With reference to FIGS. 1 and 6, in one embodiment, a third gap d3 is formed between the first antenna module 1 and the device housing 8. A fourth gap d4 is formed between the first antenna module 1 and the mainboard 7. The third gap d3 is less than 30% of the sum of the third gap d3 and the fourth gap d4. This gap ratio can help reduce the amount of interference on the signal transmission coming from the device housing 8.

With reference to FIG. 1, in one embodiment, the signal transmission device D further comprises a thermal pad 62. The thermal pad 62 is attached to the heat dissipation member 4. The thermal pad 62 contacts the device housing 8 to improve heat conductivity between the heat dissipation member 4 and the device housing 8.

With reference to FIG. 1, in one embodiment, the signal transmission device D further comprises a central processing unit 71, a 5G baseband module 72, a 4G baseband unit 73 and an LTE baseband unit 74. The central processing unit 71, the 5G baseband module 72, the 4G baseband unit 73 and the LTE baseband unit 74 are disposed on the mainboard 7. The 4G baseband unit 73 is located between the central processing unit 71 and the 5G baseband module 72, and the 5G baseband module 72 is located between the 4G baseband unit 73 and the LTE baseband unit 74.

With reference to FIGS. 1 and 2, in one embodiment, the first antenna module 1 is coupled to the mainboard 7 via flexible transmission line 19.

Utilizing the signal transmission device of the embodiment of the invention, the first antenna module is disposed on the heat dissipation member, and the heat dissipation member is partially located between the first antenna module and the mainboard. Therefore, there is less interference from the mainboard on the first antenna module. Additionally, the heat generated by the first antenna module is directly dissipated via the heat dissipation member, and an improved heat dissipation effect is achieved.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term).

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A signal transmission device, comprising:

a heat dissipation member;

a first antenna module, disposed on and thermally connected to the heat dissipation member;

a positioning clamp, disposed on the heat dissipation member, wherein the first antenna module is sandwiched between the positioning clamp and the heat dissipation member, the positioning clamp is adapted to restrict the first antenna module, the positioning clamp comprises a plurality of clamp openings exposing the first antenna module and a plurality of spacing ribs defining the openings, wherein the first antenna module comprises a plurality of first antenna units, and each spacing rib is disposed between the two adjacent first antenna units.

2. The signal transmission device as claimed in claim 1, wherein each first antenna unit comprises a first dipole antenna area, each rib comprises a rib notch, a notch width of the rib notch in an extending direction of the spacing rib is greater than or equal to a width of the first dipole antenna area in the extending direction of the spacing rib.

3. The signal transmission device as claimed in claim 2, wherein each first antenna unit further comprises a first patch antenna area, the first dipole antenna area comprises a dipole antenna and an empty area, and the empty area is located between the dipole antenna and the first patch antenna area.

4. The signal transmission device as claimed in claim 3, wherein the first antenna module comprises a plurality of ground areas, each ground area is located between the two adjacent first patch antenna areas, and the spacing ribs respectively contact the ground areas.

5. The signal transmission device as claimed in claim 2, wherein each clamp opening is rectangular, each clamp opening comprises a first edge, a second edge, a third edge, and a fourth edge, the first edge is parallel to the second edge, the third edge is parallel to the fourth edge, the first edge is perpendicular to the third edge, the third edge is located on a corresponding spacing rib, the first edge is adjacent to the first dipole antenna area relative to the second edge, a first gap is formed between the first edge and the first antenna module, and the first gap is greater than 2 mm.

6. The signal transmission device as claimed in claim 5, wherein a second gap is formed between the second edge and the first antenna module, and the second gap is greater than 2 mm.

7. The signal transmission device as claimed in claim 1, wherein the first antenna module further comprises a module circuit board and a module chip, the module circuit board comprises a first surface and a second surface, the first surface is opposite the second surface, the first antenna unit is disposed on the first surface, the module chip is disposed on the second surface, and the module chip is thermally connected to the heat dissipation member.

8. The signal transmission device as claimed in claim 7, wherein the heat dissipation member comprises a receiving groove, the first antenna module is disposed in the receiving groove, and the module chip is thermally connected to the receiving groove.

9. The signal transmission device as claimed in claim 7, further comprising a bolt, wherein the bolt affixes the positioning clamp to the heat dissipation member.

10. The signal transmission device as claimed in claim 1, further comprising a second antenna module and a third antenna module, the positioning clamp comprises a first section, a second section and a third section, the first section is adapted to restrict the first antenna module, the second section is adapted to restrict the second antenna module, the third section is adapted to restrict the third antenna module, and the first antenna module is located between the second antenna module and the third antenna module.

11. The signal transmission device as claimed in claim 10, wherein the heat dissipation member comprises a planar surface, a first inclined surface and a second inclined surface, the planar surface is interconnected between the first inclined surface and the second inclined surface, the first antenna module is disposed on the planar surface, the second antenna module is disposed on the first inclined surface, and the third antenna module is disposed on the second inclined surface.

12. The signal transmission device as claimed in claim 11, wherein the heat dissipation member comprises a heat dissipation member protrusion, the first dipole antenna area and the first patch antenna area of each first antenna unit are arranged in a first direction, the first patch antenna area is located between the first dipole antenna area and the heat dissipation member protrusion, the second antenna module comprises a second dipole antenna area and a second patch antenna area, the second dipole antenna area and the second patch antenna area are arranged in a second direction, and the first direction is opposite of the second direction.

13. The signal transmission device as claimed in claim 1, further comprising a mainboard and a device housing, wherein the heat dissipation member is partially located between the first antenna module and the mainboard, and the device housing covers the first antenna module and the heat dissipation member.

14. The signal transmission device as claimed in claim 13, wherein a third gap is formed between the first antenna module and the device housing, a fourth gap is formed between the first antenna module and the mainboard, and the third gap is less than 30% of a sum of the third gap and the fourth gap.

15. The signal transmission device as claimed in claim 13, further comprising a thermal pad, wherein the thermal pad is attached to the heat dissipation member, and the thermal pad contacts the device housing.

16. The signal transmission device as claimed in claim 13, further comprising a central processing unit, a 5G baseband module, a 4G baseband unit and an LTE baseband unit, wherein the central processing unit, the 5G baseband module, the 4G baseband unit and the LTE baseband unit are disposed on the mainboard, the 4G baseband unit is located between the central processing unit and the 5G baseband module, and the 5G baseband unit is located between the 4G baseband unit and the LTE baseband unit.

* * * * *